US005733209A

United States Patent [19]

McIntyre, IV

[11] Patent Number: 5,733,209

[45] Date of Patent: Mar. 31, 1998

[54] PNEUMATIC BALL LAUNCHING APPARATUS

[76] Inventor: James O. McIntyre, IV, P.O. Box 441, Angleton, Tex. 77515

[21] Appl. No.: 578,859

[22] Filed: Dec. 27, 1995

Related U.S. Application Data

[63] Continuation-in-part of Ser. No. 352,911, Dec. 9, 1994, abandoned.

[51] Int. Cl.[6] ..... A63B 69/40

[52] U.S. Cl. ..... 473/436; 473/422; 473/133

[58] Field of Search ..... 273/26 R; 473/131, 473/132, 133, 135–136, 137

[56] References Cited

U.S. PATENT DOCUMENTS

| | | | |
|---|---|---|---|
| 1,952,113 | 3/1934 | Beckett | 473/137 |
| 2,335,820 | 11/1943 | Hogeberg | 473/136 |
| 3,298,694 | 1/1967 | Turnau | 473/137 |
| 3,378,263 | 4/1968 | Turneau | 473/136 |
| 3,533,631 | 10/1970 | Hladek | 473/136 |

*Primary Examiner*—Theatrice Brown
*Attorney, Agent, or Firm*—Kenneth A. Roddy

[57] ABSTRACT

A pneumatic ball launching apparatus propels a ball vertically upward into mid-air without imparting spin on the ball. A pneumatic cylinder is disposed vertically below the top surface of a ground supported platform in axial alignment with the center of an aperture in the top surface of the platform. The pneumatic cylinder has a spring return piston rod with a cup-shaped ball holder secured to its outer end. The cylinder is connected through a valve to a source of pressurized air and the valve is controlled by a timing device. The platform has a downwardly inclined forward portion which slopes inwardly and downwardly from each lateral side to form a central low portion at its forward end. A net extends vertically upward from the forward portion of the platform to catch balls which have hit. A conveyor belt installed in a channel in the forward portion of the platform travels in an endless loop to collect balls which have been hit and carry them toward the pneumatic cylinder and drop them into a queuing ramp having a ball shuttle controlled by the timing device which drops them one at a time into the cup-shaped ball holder. After one ball drops into the ball holder, the timing device opens the valve to supply a blast of air to the cylinder causing the piston rod to travel rapidly upward and stop abruptly to propel the ball from the ball holder vertically upward through the aperture in the platform. The balls hit by the batter into the net drop down and roll to the low portion of the platform to be recycled.

8 Claims, 5 Drawing Sheets

PNEUMATIC BALL LAUNCHING APPARATUS

CROSS-REFERENCE TO RELATED APPLICATION

This application is a Continuation-In-Part of U.S. patent application Ser. No. 08/352,911, filed Dec. 9, 1994, (abandoned).

BACKGROUND OF THE INVENTION

1. Field of the Invention

This invention relates generally to batting practice apparatus and ball launching apparatus, and more particularly to a pneumatic ball launching apparatus which launches a ball a consistent distance upwardly into mid-air without imparting spin to the ball prior to being hit by the user.

2. Brief Description of the Prior Art

A variety of batting practice apparatus and ball launching apparatus are known. There are several patents which disclose various batting practice and ball launching apparatus, most of which either launch a ball horizontally toward the batter, propel the ball vertically by a blast of air, or suspend the ball on a column of continuous upwardly directed air.

Blaski, U.S. Pat. No. 2,152,680 discloses a ball teeing apparatus having a slanted floor which feeds delivers balls that have been hit into a net through a slanted tube and onto a tee beneath the floor and the tee is then moved upwardly to place the ball above the floor surface.

Gale, U.S. Pat. No. 2,212,877 discloses another ball teeing device having a ramp which feeds balls onto a pivoting arm which is released by a latch and moves between an upright position and a horizontal position. A ball is carried on the outer end of the arm an placed on a tee.

Smith, U.S. Pat. No. 4,220,331 discloses a baseball retrieval system having a sloping floor and a sump where the balls are collected and a conveyor which delivers the balls to an elevated distribution hopper and a plurality of gravity tube magazines feed the balls to respective pitching machines.

McClure et al, U.S. Pat. No. 4,564,195 discloses a tennis ball support device which is adapted to hold a tennis ball in mid-air on a column of air provided by a blower inside the support device.

Miles, U.S. Pat. No. 4,575,080 discloses an air suspension batting tee apparatus which includes an air blower for providing a moving air column which supports a ball, a conduit for directing the air column, and an oscillator for producing a fluctuation in the flow of air. A ball suspended in the air column may be made to oscillate vertically, and an air flow displacement arm may be used to produce oscillating movement of the ball in a cylindrical path around a vertical axis to simulate a curve ball or screw ball.

Kholin, U.S. Pat. No. 4,774,928 discloses a ball pitching apparatus which includes a horizontal firing tube which is connected to a source of compressed air wherein the ball is launched toward the batter in a generally horizontal direction.

Marello et al, U.S. Pat. No. 5,011,144 discloses an air suspension ball support tee apparatus which includes an air compressor for providing an air column which supports a ball. The ball support tee has a blind core within an annular cone-shaped nozzle which produces an annular flow of air which expands laterally and creates a converging and diverging air flow. The ball is supported from below by the air flow and is stably cradled as the expanding annular air flow diverges, such that the ball remains in a stable central position above the nozzle.

Sharp, U.S. Pat. No. 5,133,330 discloses a ball pitching apparatus which includes a horizontal firing tube which is connected to a high volume source of air, such as a leaf blower, wherein the ball is sucked into the firing tube and launched toward the batter in a generally horizontal direction.

Leon, U.S. Pat. No. 5,160,131 discloses a batting practice apparatus which pneumatically projects a series of balls in an upward vertical direction wherein the ball rolls through a serpentine tubular launcher having a horizontal projection tube portion with an L-shaped member at its outer end. A blower or other source of compressed gas is connected to the rear portion of the projection tube. The ball rolls through the serpentine tubular launcher and enters the projection tube portion, at which point an impinging stream of air drives the ball horizontally through the projection tube and then vertically upward through the L-shaped member. Obviously, this ball path and launching system would impart spin to the launched ball.

Meade, U.S. Pat. No. 5,294,109 discloses a ball tossing device having a ramp which feeds balls onto the upper rim of a hollow cylinder and a spring biased plunger connected to a solenoid launches the ball. A rocker arm and spring biased dual pivoting rod mechanism releases a single ball from a line of balls onto the rim of the hollow cylinder when the plunger is in a retracted position.

Wood, U.S. Pat. No. 5,337,726 discloses a hand-held pneumatic ball thrower having a pistol grip trigger mechanism and a launch tube which holds only one ball and launches the ball with a pressurized gas ram.

Those types of apparatus which launch a ball horizontally toward the batter will impart spin on the ball as it is launched and passes through the air toward the batter. They also require a substantial distance between the launcher and the batter. Those types of apparatus which propel the ball vertically by a blast of air will also impart spin on the ball. Those types of apparatus which suspend the ball on a column of continuous upwardly directed air will also impart spin on the ball and will tend to oscillate the ball vertically as it attempts to achieve equilibrium between its weight and the force of the air stream. They also have the annoying loud sound of the continuously running blower or compressor.

Another disadvantage of prior art apparatus which propel the ball vertically upward or suspend the ball on a column of air is that the apparatus which propels or suspends the ball is located closely adjacent the batter and extends from the ground to a point between the knees and waist of the batter and can physically and mentally interfere with the swing of the person attempting to hit the ball.

The present invention is distinguished over the prior art in general, and these patents in particular by a pneumatic ball launching apparatus which propels a ball vertically upward into mid-air without imparting spin on the ball. A pneumatic cylinder is disposed vertically below the top surface of a ground supported platform in axial alignment with the center of an aperture in the top surface of the platform. The pneumatic cylinder has a spring return piston rod with a cup-shaped ball holder secured to its outer end. The cylinder is connected through a valve to a source of pressurized air and the valve is controlled by a timing device. The platform has a downwardly inclined forward portion which slopes inwardly and downwardly from each lateral side to form a central low portion at its forward end. A net extends vertically upward from the forward portion of the platform to catch balls which have hit. A conveyor belt installed in a channel in the forward portion of the platform travels in an endless loop to collect balls which have been hit and carry them toward the pneumatic cylinder and drop them into a queuing ramp having a ball shuttle controlled by the timing device which drops them one at a time into the cup-shaped ball holder. After one ball drops into the ball holder, the timing device opens the valve to supply a blast of air to the cylinder causing the piston rod to travel rapidly upward and stop abruptly to propel the ball from the ball holder vertically upward through the aperture in the platform. The balls hit by the batter into the net drop down and roll to the low portion of the platform to be recycled.

SUMMARY OF THE INVENTION

It is therefore an object of the present invention to provide a pneumatic ball launching apparatus which will not impart spin on the ball as it is launched.

It is another object of this invention to provide a pneumatic ball launching apparatus which does not propel the ball horizontally toward the user and does not require a substantial amount of space in use.

Another object of this invention is to provide a pneumatic ball launching apparatus which does not suspend the ball on a continuous column of air and does not require the user to wait until the ball achieves equilibrium on an air column.

Another object of this invention is to provide a pneumatic ball launching apparatus which propels balls vertically upward and the ball propelling apparatus will not physically interfere with the swing of the person attempting to hit the ball.

Another object of this invention is to provide a pneumatic ball launching apparatus which can be adjusted to precisely control the height the balls are propelled vertically to provide a desired strike zone corresponding to the height of the person attempting to hit the ball.

Another object of this invention is to provide a pneumatic ball launching apparatus which is silent except for the short period of time when the ball is launched.

Another object of this invention is to provide a pneumatic ball launching apparatus which conserves air by utilizing air only for a short period of time when the ball is dropped into place and launched.

A further object of this invention is to provide a pneumatic ball launching apparatus which has a ball collector and continuous ball return and does not require shut-down for reloading.

A still further object of this invention is to provide a pneumatic ball launching apparatus which is simple in construction, economical to manufacture, and reliable in operation.

Other objects of the invention will become apparent from time to time throughout the specification and claims as hereinafter related.

The above noted objects and other objects of the invention are accomplished by a pneumatic ball launching apparatus which propels a ball vertically upward into mid-air without imparting spin on the ball. A pneumatic cylinder is disposed vertically below the top surface of a ground supported platform in axial alignment with the center of an aperture in the top surface of the platform. The pneumatic cylinder has a spring return piston rod with a cup-shaped ball holder secured to its outer end. The cylinder is connected through a valve to a source of pressurized air and the valve is controlled by a timing device. The platform has a downwardly inclined forward portion which slopes inwardly and downwardly from each lateral side to form a central low portion at its forward end. A net extends vertically upward from the forward portion of the platform to catch balls which have hit. A conveyor belt installed in a channel in the forward portion of the platform travels in an endless loop to collect balls which have been hit and carry them toward the pneumatic cylinder and drop them into a queuing ramp having a ball shuttle controlled by the timing device which drops them one at a time into the cup-shaped ball holder. After one ball drops into the ball holder, the timing device opens the valve to supply a blast of air to the cylinder causing the piston rod to travel rapidly upward and stop abruptly to propel the ball from the ball holder vertically upward through the aperture in the platform. The balls hit by the batter into the net drop down and roll to the low portion of the platform to be recycled.

DESCRIPTION OF THE PREFERRED EMBODIMENT

Figure 1:
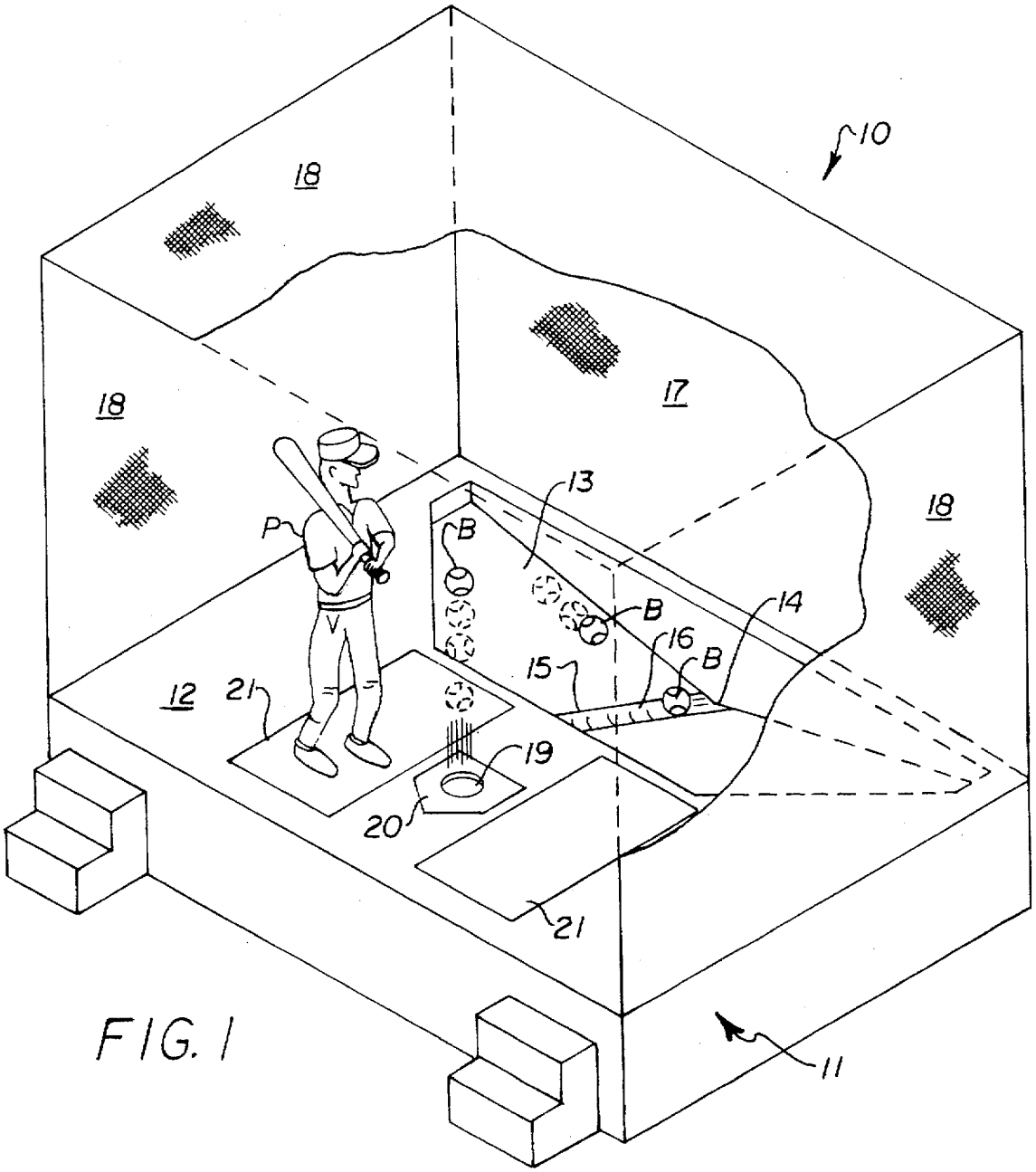
FIG. 1 is a perspective view of the pneumatic ball launching apparatus in accordance with the present invention.

Referring to the drawings by numerals of reference, there is shown in FIG. 1, a preferred pneumatic ball launching apparatus 10. A deck or platform 11 is supported on the ground surface and has a horizontal top surface 12 and a forward portion 13 which slopes outwardly and downwardly therefrom. The forward portion 13 also slopes inwardly and downwardly from each lateral side to form a central low portion 14 at the forward end and has a narrow open channel 15 extending a distance from the central low portion back toward the horizontal top surface 12. A ball conveyor belt 16 (described hereinafter) is installed in the channel 15. A back drop curtain or net 17 extends vertically upward from the forward end of the forward portion 13 of the platform to catch balls B which have hit. Nets 18 may also be positioned on each side and above the platform 11. The top surface 12 of the platform 11 has an aperture 19 therethrough and an area on each side of the aperture in which the batter or person P hitting the balls stands.

Alternatively, the forward portion 13 of the platform 11 and channel 15 may be configured to slope rearwardly and downwardly from the net 17, such that the collected balls will roll down the incline by gravity, rather than utilizing the conveyor belt 16.

In the illustrated example, the apparatus 10 is being used to launch baseballs or softballs and the top surface 12 is decorated with a "home plate" 20 which surrounds the aperture 19 and a "batter's box" 21 on each side of the "home plate". However, it should be understood that the apparatus may be used for launching various other types of balls, such as tennis balls or handballs, which may be hit with a bat or racket.

Figure 2:
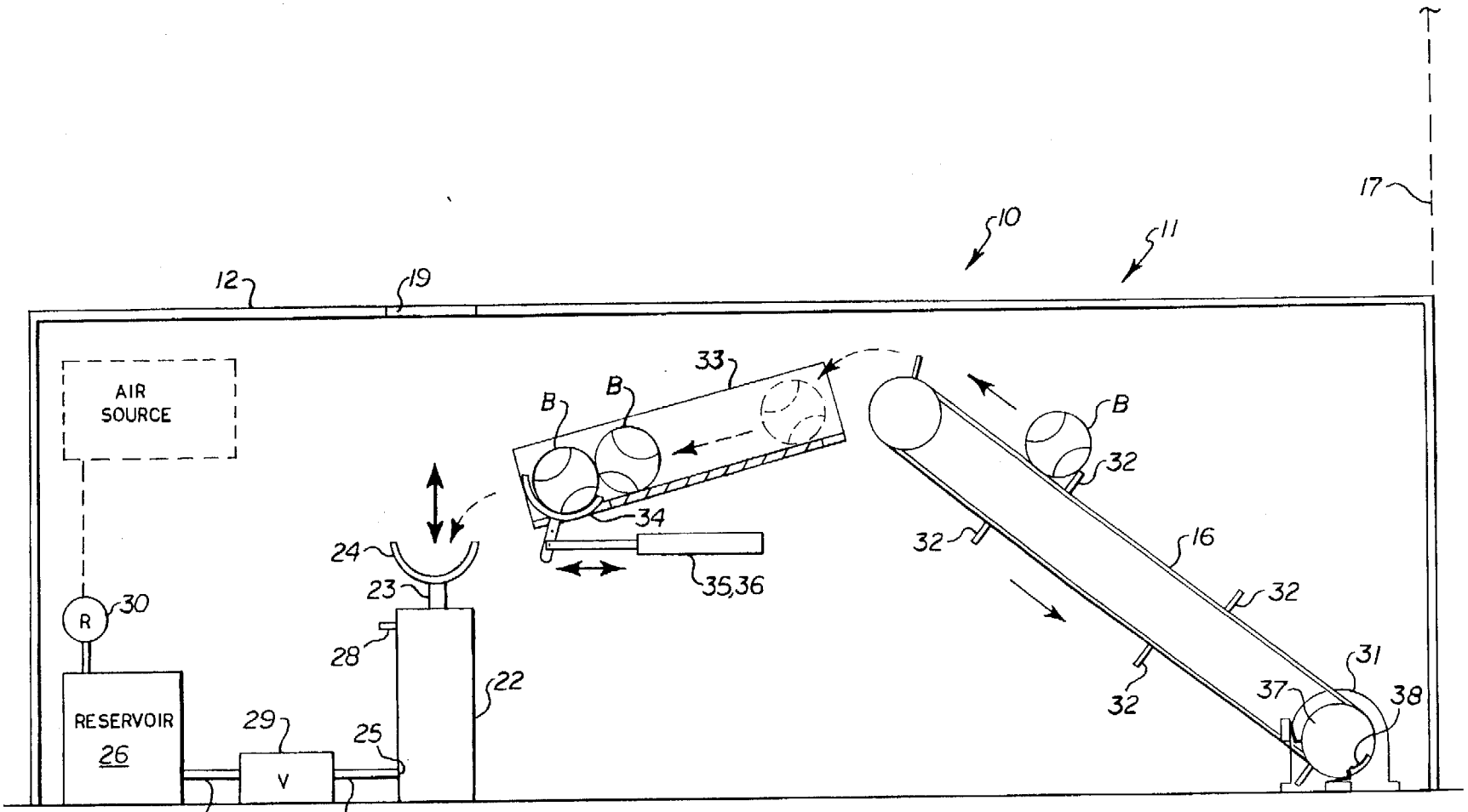
FIG. 2 is a side view showing schematically the ball loading, ball launching and ball return apparatus.

Referring additionally to FIG. 2, a spring return pneumatic cylinder 22 is vertically disposed below the top surface 12 of the platform 11 with its longitudinal axis in axial alignment with the center of the aperture 19 in the top surface. The pneumatic cylinder 22 has an extendible piston rod 23 with a cup-shaped ball holder 24 secured to its outer end. The pneumatic cylinder 22 has an inlet port 25 connected to an air reservoir 26 via supply line 27, and an exhaust outlet 28 open to atmosphere. A pilot operated diaphragm valve 29 is installed in the supply line 27 between the reservoir 26 and the pneumatic cylinder 22. The reservoir 26 may be provided with a fitting for supplying air from an air source, or may be a self contained air tank. The air pressure in the reservoir 26 is controlled by a regulator 30. In a preferred embodiment, the reservoir 26 has a storage capacity of at least ten-times the capacity of the pneumatic cylinder 22. The pressure level dictates the height the ball will reach when launched, and can be adjusted to precisely control the height the balls are propelled vertically to provide a desired strike zone corresponding to the height of the person attempting to hit the ball.

The conveyor belt 16 is driven by a gearmotor 31 to travel in an endless loop. The conveyor belt 16 has a series of longitudinally spaced upstanding projections or fins 32 thereon that carry balls B which are collected at the central low portion 14 of the slopped forward portion 13 of the deck 11 upwardly and rearwardly back toward the pneumatic cylinder 22 (FIG. 1). In a preferred embodiment, 4 to 6 balls may be circulated through the system at any one time.

An inclined trough-shaped queuing ramp 33 is positioned beneath the rearward end of the conveyor belt 16. The conveyor belt 16 drops balls into the queuing ramp 33 as it makes its return back downward. A cup shaped ball shuttle 34 is pivotally connected at the lower end of the queuing ramp 33 and operated by an air cylinder 35 or an electrical solenoid valve 36 (described hereinafter) to pivot relative to the lower end of the queuing ramp. The ball shuttle 34 is sized and positioned such that when pivoted to a first position, a single ball will roll into the cup-shaped upper portion, and when pivoted to a second position, the cup-shaped portion will drop the ball into the cup-shaped ball holder 24 secured to the outer end of the piston rod 23 of the pneumatic cylinder 22. In the second position, the outer surface of the cup-shaped portion of the ball shuttle 34 engages the next ball in line on the queuing ramp 33 to prevent it from rolling off the end.

Alternatively, the forward portion 13 of the platform 11 and channel 15 may be configured to slope rearwardly and downwardly from the net 17, such that the collected balls will roll down the incline by gravity and become aligned on the queuing ramp 33, rather than utilizing a conveyor belt.

Figure 3:
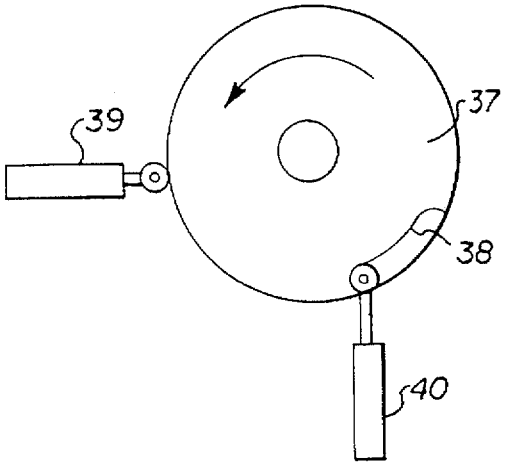
FIG. 3 is a schematic illustration of the cam operated timing mechanism used in an all pneumatic system for ball loading and ball launching.
Figure 5:
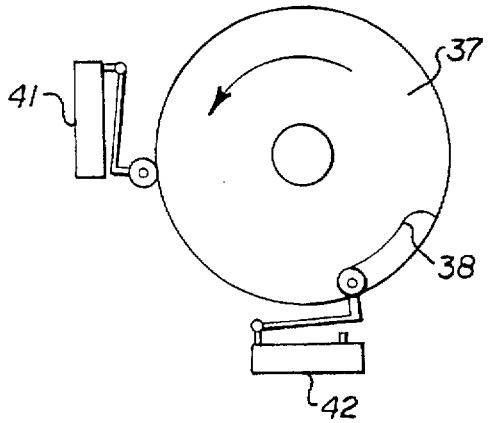
FIG. 5 is a schematic illustration of the cam operated timing mechanism used in an a electrical pneumatic system for ball loading and ball launching.
Figure 4:
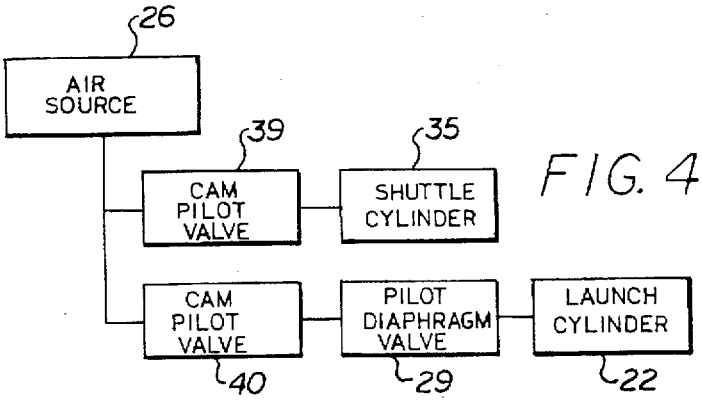
FIG. 4 is a block diagram of the control circuitry which pneumatically controls the operation of the ball loading and ball launching apparatus.
Figure 6:
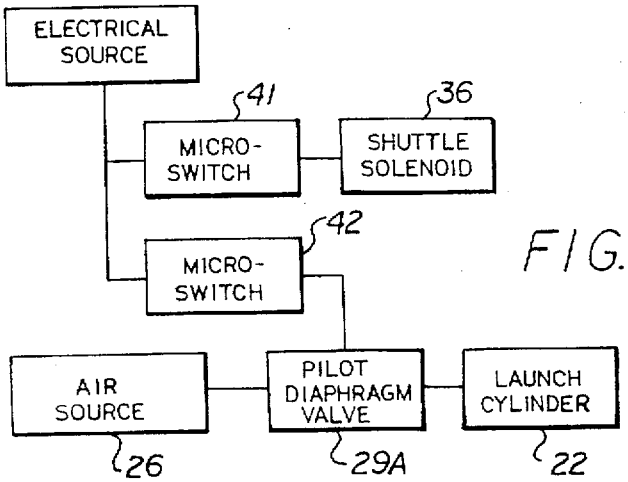
FIG. 6 is a block diagram of the alternate electrical pneumatic control circuitry which controls the operation of the ball loading and ball launching apparatus.

The control of the ball launcher may be accomplished by an all pneumatic control system as shown in FIGS. 3 and 4, or alternatively, by an electrical pneumatic control system as shown in FIGS. 5 and 6. The all pneumatic control system utilizes a pilot controlled pneumatic cylinder 35 to pivot the ball shuttle 34, whereas the electrical pneumatic system utilizes an electric solenoid 36 in place of the cylinder 35.

The all pneumatic control system is shown somewhat schematically in FIGS. 3 and 4. A cam wheel 37 having a cam element or recessed cam section 38 on its periphery is secured to the shaft of the gearmotor 31 that drives the conveyor belt 16. During rotation of the cam wheel 37, the cam section 38 engages a first and second spring loaded pilot valve 39 and 40. When contacted by the cam section 38 or the cam wheel 37, the first pilot valve 39 opens to supply air to the shuttle cylinder 35 to retract its piston rod and pivot the ball shuttle 34. After the cam section passes the pilot valve 39 closes. When the cam section 38 contacts the second pilot valve 40, the cam actuated valve sends a pilot signal to the diaphragm valve 29 which opens to supply a blast of air to the pneumatic cylinder 22, thus launching the ball.

An electrical pneumatic control system is shown somewhat schematically in FIGS. 5 and 6, which utilizes the cam wheel 37 having a cam element or recessed cam section 38 on its periphery, but utilizes a first and second microswitch 41 and 42 connected with an electrical power source. In this embodiment, the pilot operated diaphragm valve 29 connected between the air source and the pneumatic cylinder 22 is actuated by an electrical pilot signal, and the ball shuttle 34 is operated by a solenoid 36. During rotation of the cam wheel 37, when the cam section 38 contacts the first microswitch 41, an electrical signal is sent to the solenoid 36 to retract its plunger and pivot the ball shuttle 34. After the cam section passes the microswitch 41 closes. When the cam section 38 contacts the second microswitch 42, the microswitch sends a pilot signal to the diaphragm valve 29 which opens to supply a blast of air to the pneumatic cylinder 22, thus launching the ball.

The time interval between pivoting of the ball shuttle 34 to position the ball and the ball launch is controlled by the circumferential distance the two cam actuated valves 39 and 40 or the two microswitches 41 and 42 are spaced apart. The time interval between successive ball launches is controlled by the rotational speed of the motor.

Figure 7A:
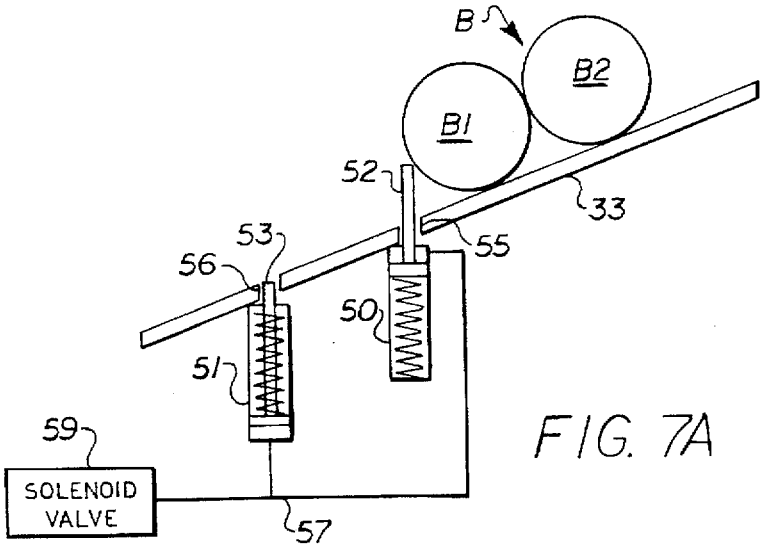
FIGS. 7A–7C are schematic illustrations of a pneumatic ball loading arrangement using a pair of pneumatic cylinders.
Figure 7B:
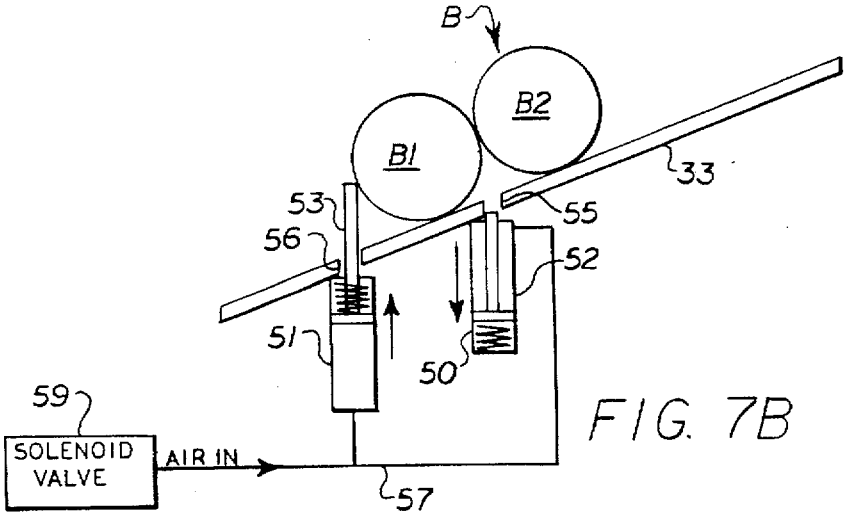
Figure 7C:
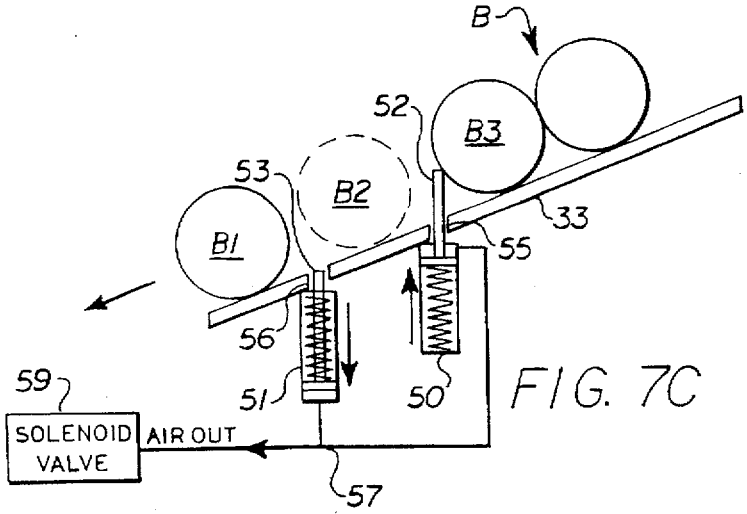

FIGS. 7A–7C and 8 illustrate schematically an electronically controlled pneumatic ball loading arrangement. As shown in FIGS. 7A–7C, the ball shuttle mechanism is replaced by a pair of spring biased pneumatic cylinders 50 and 51 mounted beneath the inclined trough-shaped queuing ramp 33 with their piston rods 52 and 53 extendible and retractable through holes 55 and 56 in the ramp. Cylinder 50 is spring biased to normally extend its piston rod 52, and cylinder and cylinder 51 is spring biased to normally retract its piston rod 53 (FIG. 7A). The cylinders 50 and 51 are connected together through an air line 57 such that when air is supplied through the line, the piston rod 52 of cylinder 50 will be retracted and simultaneously the piston rod 53 of cylinder 51 will be extended (FIG. 7B). When air is dumped from the line, piston rod 52 of cylinder 50 will be extended by its spring and simultaneously the piston rod 53 of cylinder 51 will be retracted by its spring (FIG. 7C).

Figure 8:
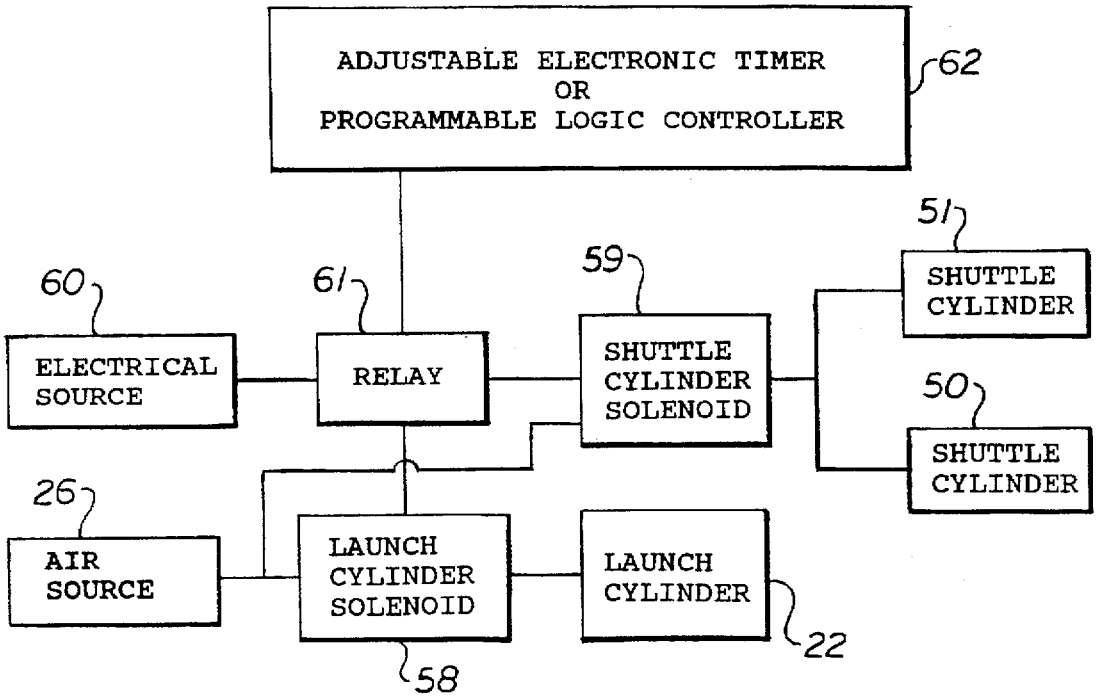
FIG. 8 is a block diagram of an electronic control system which utilizes an electronic timer or programmed logic controller to control the operation of the ball loading and ball launching apparatus.

As shown schematically in FIG. 8, the pilot operated diaphragm valve 29 is replaced by a solenoid valve 58 installed in the air supply line. The launch cylinder 22 is connected to the air source 29 through the solenoid valve 58 and the cylinders 50 and 51 are connected to the air source 29 through a solenoid valve 59. The solenoid valves 58 and 59 are connected to an electrical power source 60 through a relay 61. The relay 61 is controlled by an adjustable electronic timer or programmable logic controller 62. The solenoid valves, relay, and adjustable electronic timer or programmable logic controller are conventional in the art, and therefore not shown in detail.

Referring again to FIGS. 7A–7C, the cylinders 50 and 51 are spaced a distance apart to allow a single ball to be positioned between their piston rods 52 and 53. When the balls B are aligned single file on the ramp 33, the extended piston rod 52 of cylinder 50 prevents the first ball in line B1 from rolling down the ramp 33 (FIG. 7A). When air is supplied to the cylinder 50 its piston rod 52 is retracted allowing the ball B1 to roll down the ramp, and simultaneously the piston rod 53 of cylinder 51 is extended (FIG. 7B) to prevent the ball B1 from rolling off the ramp into the cup-shaped ball holder secured to the piston rod of the launch cylinder 22. When air is dumped, piston rod 53 is retracted by its spring allowing the ball B1 to then roll off the ramp into the cup-shaped ball holder secured to the piston rod of the launch cylinder 22, and simultaneously piston rod 52 of cylinder 50 is extended by its spring to prevent the next ball in line B3 from rolling down the ramp and the cycle is repeated.

OPERATION

A quantity of balls are dumped onto the forward portion of the slopped deck 13 and roll down the incline to be collected at the central low portion 14 (FIG. 1). The batter assumes his or her position on the platform and turns on power to the gearmotor 31 which causes the conveyor belt 16 to travel in its loop. The upstanding projections or fins 32 on the conveyor belt engage the collected balls B one at a time and carry them upwardly and rearwardly back toward the pneumatic cylinder 22, and as the conveyor belt makes its return, drops the balls in the downwardly inclined queuing ramp 33. The balls roll down the queuing ramp 33. The first ball enters the cup-shaped ball shuttle 34 and the subsequent balls become aligned single file in the queuing ramp 33 behind the first ball.

Alternatively, the forward portion 13 of the platform 11 and channel 15 may be configured to slope rearwardly and downwardly from the net 17, such that the collected balls will roll down the incline by gravity and become aligned on the queuing ramp 33, rather than utilizing a conveyor belt.

In the embodiment having a mechanical timing control system, during operation of the motor 31, the cam wheel 37 rotates and when the cam section 38 on its periphery contacts the first cam actuated valve 39 (or microswitch 41) it opens to supply air to the shuttle cylinder 35 to retract its piston rod and pivot the ball shuttle 34. Alternatively, in the electrical pneumatic system, the cam section 38 would contact the first microswitch 41 which completes an electrical circuit through the solenoid valve 36 to retract its plunger and pivot the ball shuttle 34. As the ball shuttle 34 pivots, it dumps the first ball into the cup-shaped ball holder 24, and the exterior surface of the ball shuttle 34 engages the next ball in line to prevent it from rolling into the shuttle and retains the aligned balls in the queuing ramp 33. After the cam section 38 passes the first valve 39 or microswitch 41, and the first ball has been dropped into the ball holder, the piston rod or plunger is extended to pivot the ball shuttle 34 in the reverse direction, such that the next ball in line enters the cup-shaped ball shuttle 34 and the subsequent balls remain aligned in single file in the queuing ramp 33.

As the cam wheel 37 continues to rotate, the cam surface 38 then contacts the second valve 40 or second microswitch 42 which sends a pilot signal to open the diaphragm valve 29 to supply a blast of air to the pneumatic cylinder 22.

In the electronically controlled pneumatic ball shuttle arrangement (FIGS. 7A–7C and 8), air to the pneumatic launch cylinder 22 and the ball loading cylinders 50 and 51 is pre-programmed and controlled by the adjustable electronic timer or programmable logic controller 62. At the preset time, relay 61 sends a signal to open solenoid valve 59 to supply air to the ball loading cylinders 50 and 51, which have allowed a ball to drop into the cup-shaped ball holder 24 (as described above), and to open solenoid valve 58 to supply a blast of air to the launch cylinder 22.

The blast of air to the launch cylinder 22 causes the piston rod 23 to travel rapidly upward and then stop abruptly when it reaches the end of its travel. This propels the ball B which is carried in the ball holder 24 vertically upward through the aperture 19 in the deck 12. The spring return of the pneumatic cylinder 22 returns the piston rod 23 to its retracted position. The cup-shaped ball holder 24 and vertical launch method does not impart spin on the ball as it is launched.

As the ball travels upward through the aperture 19, or begins its descent, the batter swings the bat or racket hitting the ball into the back drop net 17. The ball is caught by the net and drops down onto the slopped deck 13 and rolls down to the central low portion 14.

The pressure level dictates the height the ball will reach when launched, and the regulator can be adjusted to precisely control the height the balls are propelled vertically to provide a desired strike zone corresponding to the height of the person attempting to hit the ball.

The conveyor belt 16 runs continuously to carry all the balls which have been hit and collected back up toward the launch cylinder and dumps them into the queuing ramp 33. The ball shuttle 34 drops another ball into the cup-shaped ball holder 24 to be launched as the cam section 38 again contacts the valves 39 and 40 or microswitches 41 and 42. Alternatively, the adjustable electronic timer or programmable logic controller 62, at the preset time, energizes relay 61 sending a signal to open solenoid valve 59 to supply air to the ball loading cylinders 50 and 51 which have allowed another ball to drop into the cup-shaped ball holder 24 (as described above), and to open solenoid valve 58 to supply a blast of air to the launch cylinder 22. Thus, reloading and launching is automatic and continuous.

While this invention has been described fully and completely with special emphasis upon preferred embodiments, it should be understood that within the scope of the appended claims the invention may be practiced otherwise than as specifically described herein.

I claim:

1. A pneumatic ball launching apparatus comprising;

a vertically positioned pneumatic launch cylinder having an axially extendible piston rod including spring means for automatically retracting said piston rod after extensions, said pneumatic launch cylinder connected with a source of air under pressure for rapidly extending said piston rod; and a generally cup-shaped ball holder member secured on an outer end of said piston rod;

adjustable regulating means connected between said source of air under pressure and said pneumatic launch cylinder for selectively controlling the pressure of air delivered thereto;

ball queuing ramp means having a lower end disposed adjacent to said cup-shaped ball holder member, an opposed upper end adapted to receive a plurality of balls, and a longitudinal portion extending angularly upward therebetween configured to position and support balls in a descending row along said longitudinal portion;

pneumatically operated ball shuttle means at said lower end of said ball queuing ramp means disposed between said said cup-shaped ball holder member and said descending row of balls, said ball shuttle means being movable between a first position to receive and engage a lowermost one of said balls and a second position to engage a second lowermost one of said balls while releasing said lowermost ball allowing it to drop into said cup-shaped ball holder member;

a first solenoid valve operatively connected between said source of air and said vertically positioned pneumatic launch cylinder for delivering a momentary charge of pressurized air thereto thereby actuating said launch cylinder;

a second solenoid valve operatively connected between said source of air and said ball shuttle means for delivering a momentary charge of pressurized air thereto to move said ball shuttle means between said first and said second positions; and adjustable electronic timing means including a relay connected with a source of power, said relay connected with said first and said second solenoid valve for controlling the sequence of operation thereof;

said adjustable electronic timing means controlling the time interval between delivery of said momentary charge of air to said ball shuttle means and the delivery of said momentary charge of pressurized air to said pneumatic launch cylinder such that said launch cylinder is actuated after said ball shuttle means is moved from said first position to said second position and said lowermost ball is dropped into said cup-shaped ball holder member; whereby said ball which was dropped into said cup-shaped ball holder member is propelled a selected predetermined distance into mid-air upon said launch cylinder piston rod reaching the limit of its extension and thereafter said piston rod is retracted by said spring return means; and said propelled ball has substantially no spin imparted thereto and can be hit by a person standing adjacent the vertical path of said propelled ball.

2. A pneumatic ball launching apparatus according to claim 1 wherein said adjustable electronic timing means comprises a programmable logic controller.

3. A pneumatic ball launching apparatus according to claim 1 wherein said pneumatic ball shuttle means comprises a first pneumatic cylinder having a first piston rod movable between an extended position above said ramp and a retracted position beneath said ramp and spring means for automatically extending its piston rod after retraction, and a second pneumatic cylinder having having a second piston rod movable between a retracted position beneath said ramp and an extended position beneath said ramp and spring means for automatically retracting its piston rod after extension;

said first and second pneumatic cylinders connected with said second solenoid valve; and when a momentary charge of pressurized air is delivered to said first and second cylinders, said first piston rod is retracted and said second piston rod is simultaneously extended allowing said descending row of balls to to roll down said ramp past said first piston rod and the lowermost one of said balls to be engaged and stopped by said extended second piston rod, and when air pressure is dumped from said first and second cylinders, said first cylinder spring will extend said first piston rod to engage and stop said second lowermost one of said balls from rolling down the ramp and said second cylinder spring will simultaneously retract said second piston rod allowing the previously stopped lowermost ball to roll off the ramp and drop into said ball holder member.

4. A pneumatic ball launching apparatus according to claim 1 including;

channel means having a first end positioned adjacent to said ball queuing ramp means upper end and a second end positioned a distance away therefrom for receiving a plurality of balls and directing them to said ball queuing ramp means upper end.

5. A pneumatic ball launching apparatus according to claim 1 including;

conveyor means having a first end positioned adjacent said ball queuing ramp means upper end and a second end positioned a distance away therefrom for receiving a plurality of balls and transporting them to said ball queuing ramp means upper end.

6. A pneumatic ball launching apparatus according to claim 5 including;

ball stopping means disposed a distance from said vertically positioned pneumatic cylinder for stopping balls which have been hit after being propelled into mid-air and causing them to drop downwardly; and collection means at the lower end of said ball stopping means for collecting the dropped balls and directing them onto said conveyor means second end.

7. A pneumatic ball launching apparatus according to claim 1 including;

a ground supported platform having a horizontal top surface on which a person stands to hit a vertically propelled ball and having an aperture through which a ball is propelled, and said vertically positioned pneumatic cylinder is disposed beneath said top surface in axial alignment with said aperture to propel said ball through said aperture upon said piston rod reaching the limit of its extension.

8. A method of pneumatically propelling a ball vertically upward into the air with substantially no spin imparted to the ball so that it may be hit by a person, comprising the steps of;

supporting a pneumatic launch cylinder vertically on a flat surface, said launch cylinder connected to a source of air under pressure and having a first solenoid valve between said source of air and said vertically positioned launch cylinder, and having an axially extendible piston rod and spring return means for automatically retracting said piston rod after extension, an having a generally cup-shaped ball holder member secured on an outer end of said piston rod;

providing a ball queuing ramp having a lower end disposed adjacent to said cup-shaped ball holder, an opposed upper end adapted to receive a plurality of balls, and a longitudinal portion extending angularly upward therebetween configured to position and support said balls in a descending row along said longitudinal portion;

providing pneumatically operated shuttle means at the lower end of said ball queuing ramp disposed between said cup-shaped ball holder member and said descending row of balls, said shuttle means being movable between a first position to receive and engage a lowermost one of said balls and a second position to engage a second lowermost one of said balls while releasing said lowermost ball allowing it to drop into said cup-shaped ball holder member, said ball shuttle means connected to said source of air through a second solenoid valve;

depositing a plurality of balls in said ball queuing ramp upper end; and actuating said second solenoid valve to deliver a momentary charge of pressurized air to said ball shuttle means to move said ball shuttle means from said first position to said second position allowing said lowermost ball to drop into said cup-shaped ball holder while engaging said second lowermost ball on said ramp longitudinal portion to retain said row of balls thereon; and thereafter delivering a momentary charge of pressurized air to said first solenoid valve to rapidly extend said launch cylinder piston rod and thereby propel said ball in said cup-shaped ball holder member a predetermined distance into mid-air upon said piston rod reaching the limit of its extension and thereafter retracting; whereby said propelled ball has substantially no spin imparted thereto and can be hit by a person standing adjacent the vertical path of said propelled ball.

* * * * *